United States Patent [19]

Barclay et al.

[11] 4,448,649

[45] May 15, 1984

[54] TRIVALENT CHROMIUM ELECTROPLATING BATHS

[75] Inventors: Donald J. Barclay, Winchester; William M. Morgan, Chandlers Ford; James M. Vigar, Winchester, all of England

[73] Assignee: International Business Machines Corporation, Armonk, N.Y.

[21] Appl. No.: 438,075

[22] Filed: Nov. 1, 1982

[30] Foreign Application Priority Data

Nov. 18, 1981 [GB] United Kingdom ..... 8134779

[51] Int. Cl.[3] ..... C25D 3/06

[52] U.S. Cl. ..... 204/51

[58] Field of Search ..... 204/51, 43 R

[56] References Cited

U.S. PATENT DOCUMENTS

| | | | |
|---|---|---|---|
| 1,922,853 | 8/1933 | Leipzig | 204/1 |
| 4,062,737 | 12/1977 | Barclay et al. | 204/43 R |
| 4,157,945 | 6/1979 | Ward et al. | 204/51 |
| 4,161,432 | 7/1979 | Barclay et al. | 204/51 |
| 4,256,548 | 3/1981 | Barclay et al. | 204/43 R |
| 4,278,512 | 7/1981 | Barclay et al. | 204/41 |

FOREIGN PATENT DOCUMENTS

| | | | |
|---|---|---|---|
| 35667 | 9/1981 | European Pat. Off. | 204/51 |
| 55-119192 | 9/1980 | Japan | 204/51 |
| 2018292 | 10/1979 | United Kingdom | 204/51 |
| 1591051 | 6/1981 | United Kingdom | 204/51 |
| 2071151 | 9/1981 | United Kingdom | 204/51 |
| 1602404 | 11/1981 | United Kingdom | 204/51 |

OTHER PUBLICATIONS

Chemical Abstracts, vol. 94, No. 3, p. 545, 38690d, Feb. 1981.

*Primary Examiner*—G. L. Kaplan

*Attorney, Agent, or Firm*—Francis A. Sirr

[57] ABSTRACT

A trivalent chromium electroplating solution containing trivalent chromium ions, a complexant, a buffer and a sulphur species selected from sulphites and dithionites, the complexant being selected to impart a stability constant, $K_1$, to the chromium complex which is in the range $10^6 < K_1 < 10^{12} M^{-1}$. The chromium ion molar concentration is lower than 0.01M. The complexant is selected from aspartic acid, iminodiacetic acid, nitrilotriacetic acid, 5-sulphosalicylic acid or citric acid.

11 Claims, No Drawings

TRIVALENT CHROMIUM ELECTROPLATING BATHS

TECHNICAL FIELD

This invention relates to electrodeposition of chromium and its alloys from electrolytes containing trivalent chromium ions.

BACKGROUND OF THE INVENTION

Chromium is commercially electroplated from electrolytes containing hexavalent chromium, but many attempts over the last fifty years have been made to develop a commercially acceptable process for electroplating chromium using electrolytes containing trivalent chromium salts. The incentive to use electrolytes containing trivalent chromium salts arises because hexavalent chromium presents serious health and environmental hazards—it is known to cause ulcers and is believed to cause cancer, and, in addition, has technical limitations including the cost of disposing of plating baths and rinse water.

The problems associated with electroplating chromium from solutions containing trivalent chromium ions are primarily concerned with reactions at both the anode and cathode. Other factors which are important for commercial processes are the material, equipment and operational costs.

In order to achieve a commercial process, the precipitation of chromium hydroxy species at the cathode surface must be minimized to the extent that there is a sufficient supply of dissolved, i.e., solution-free, chromium (III) complexes at the plating surface; and the reduction of chromium ions is promoted. U.S. Pat. No. 4,062,737 describes a trivalent chromium electroplating process in which the electrolyte comprises aquo chromium (III) thiocyanato complexes. The thiocyanate ligand stabilizes the chromium ions, inhibiting the formation of precipitated chromium (III) salts at the cathode surface during plating, and also promotes the reduction of chromium (III) ions. United Kingdom patent specification No. 1,591,051, described an electrolyte comprising chromium thiocyanato complexes in which the source of chromium was a cheap and readily available chromium (III) salt such as chromium sulphate.

Improvements in performance, i.e., efficiency or plating rate, plating range and termperature range, were achieved by the addition of a complexant which provided one of the ligands for the chromium thiocyanato complex. These complexants, described in U.S. Pat. No. 4,161,432, comprised amino acids such as glycine and aspartic acid, formates, acetates or hypophosphites. The improvement in performance depended on the complexant ligand used. The complexant ligand was effective at the cathode surface, to further inhibit the formation of precipitated chromium (III) species. In U.S. Pat. No. 4,161,432 it was noticed that the improvement in performance permitted a substantial reduction in the concentration of chromium ions in the electrolyte without ceasing to be a commercially viable process. In U.S. Pat. No. 4,278,512 practical electrolytes comprising chromium thiocyanato complexes were described which contained less than 30 mM chromium—the thiocyanate and complexant being reduced in proportion. The reduction in chromium concentration had two desirable effects, firstly, the treatment of rinse waters was greatly simplified and, secondly, the color of the chromium deposit was much lighter.

Oxidation of chromium and other constituents of the electrolyte at the anode are known to progressively and rapidly inhibit plating. Additionally, some electrolytes result in anodic evolution of toxic gases. An electroplating bath having an anolyte separated from a catholyte by a perfluorinated cation exchange membrane, described in United Kingdom patent specification No. 1,602,404, successfully overcomes these problems. Alternatively an additive, which undergoes oxidation at the anode in preference to chromium or other constituents, can be made to the electrolyte. A suitable additive is described in U.S. Pat. No. 4,256,548. The disadvantage of using an additive is the ongoing expense.

Japan published patent application 55-119192 describes an electrolyte for electroplating chromium which comprises trivalent chromium ions having a molar concentration greater than 0.01 M, one of aminoacetic acid, iminodiacetic acid, nitrilotriacetic acid and their salts, and one of dithionitic acid, sulphurous acid, bisulphurous acid, metabisulphurous acid and their salts. The electrolyte also contains alkali metal, alkali earth metal or ammonium salts for providing conductivity, and boric acid or borate for improving the plating and increasing the plating rate at high current densities.

U.S. Pat. No. 1,922,853 suggested the use of sulphites and bisulphites to avoid the anodic oxidation of chromium (III) ions. It was suggested that anodic oxidation could be prevented by using soluble chromium anodes and adding reducing agents such as sulphites, or by using insoluble anodes cut off from the plating electrolyte by a diaphragm.

THE INVENTION

Three related factors are responsible for many of the problems associated with attempts to plate chromium from trivalent electrolytes. These are: a negative plating potential which results in hydrogen evolution accompanying the plating reaction, slow electrode kinetics and the propensity of chromium (III) to precipitate as hydroxy species in the high pH environment which exists at the electrode surface. The formulation of the plating electrolytes of the present invention are based on an understanding of how these factors could be contained.

Cr (III) ions can form a number of complexes with ligands, L, characterized by a series of reactions which may be summarized as:

$$Cr + L = CrL \qquad K_1$$

$$CrL + L = CrL_2 \qquad K_2$$

etc.

where charges are omitted for convenience and $K_1$, $K_2$, . . . etc. are the stability constants and are calculated from:

$$K_1 = [CrL]/[Cr][L]$$

$$K_2 = [CrL_2]/[CrL][L]$$

etc.

where the square brackets represent concentrations. Numerical values may be obtained from (1) "Stability Constants of Metal-Ion Complexes", Special Publication No. 17, The Chemical Society, London 1964 - L. G. Sillen and A. E. Martell; (2) "Stability Constants of Metal-Ion Complexes", Supplement No. 1, Special Publication No. 25, The Chemical Society, London 1971 - L. G. Sillen and A. E. Martell; (3) "Critical Stability Constants", Vol. 1 and 2, Plenum Press, New York 1975 - R. M. Smith and A. E. Martell. The ranges for K given in the above reference should be recognised as being semi-quantative, especially in view of the spread of reported results for a given system and the influence of the ionic composition of the electrolyte. Herein K values as taken at 25° C.

During the plating process, the surface pH can rise to a value determined by the current density and the acidity constant, pKa, and concentration of the buffer agent (e.g. boric acid). This pH will be significantly higher than the pH in the bulk of the electrolyte, and under these conditions chromium-hydroxy species may precipitate. The value of $K_1$, $K_2$, . . . etc. and total concentrations of chromium (III) and the complexant ligand determine the extent to which precipitation occurs; the higher the values of $K_1$, $K_2$, . . . etc. the less precipitation will occur at a given surface pH. As plating will occur from solution-free (i.e., non-precipitated) chromium species, higher plating efficiencies may be expected from ligands with high K values.

However, a second consideration is related to the electrode potential adopted during the plating process If the K values are too high, plating will be inhibited because of the thermodynamic stability of the chromium complexes. Thus, selection of the optimum range for the stability constants, and of the concentrations of chromium and the ligand, is a compromise between these two opposing effects: a weak complexant results in precipitation at the interface, giving low efficiency (or even blocking of plating by hydroxy species), whereas too strong a complexant inhibits plating for reasons of excessive stability.

A third consideration is concerned with the electrochemical kinetics of the hydrogen evolution reaction (H.E.R.) and of chromium reduction. Plating will be favored by fast kinetics for the latter reaction and slow kinetics for the H.E.R. Thus, additives which enhance the chromium reduction process or retard the H.E.R. will be beneficial with respect to efficient plating rates. It has been found that sulphites and dithionites favour the reduction of chromium (III) to chromium metal.

The present invention provides a chromium electroplating electrolyte containing a source of trivalent chromium ions, a complexant, a buffer agent and a sulphur species, selected from sulphites and dithionites, for promoting chromium deposition, the complexant being selected so that the stability constant $K_1$ of the chromium complex, as defined herein, is in the range $10^6 < K_1 < 10^{12} M^{+1}$, and the chromium ions having a molar concentration lower than 0.01 M.

By way of example, complexant ligands having $K_1$ values within the range $10^6 < K_1 < 10^{12} M^{-1}$ include aspartic acid, iminodiacetic acid, nitrilotriacetic acid, 5-sulphosalicylic acid and citric acid.

The present invention also provides a chromium electrolyte containing trivalent chromium ions, a complexant, a buffer agent and a sulphur species selected from sulphites and dithionites, the complexant being selected from aspartic acid, 5-sulphosalicylic acid and citric acid.

The present invention further provides a chromium electroplating bath comprising an anolyte separated from a catholyte by a perfluorinated cation exchange membrane, the anolyte comprising sulphate ions, and the catholyte comprising a source of trivalent chromium ions, a complexant, a buffer agent and a sulphur species selected from sulphites and dithionites, and in which the source of sulphate ions is chromium sulphate. Suitable complexant ligands are aspartic acid, iminodiacetic acid, nitrilotriacetic acid, 5-sulphosalicylic acid and citric acid.

Sulphites can include bisulphites and metabisulphites.

Low concentrations of sulphite or dithionite are needed to promote reduction of the trivalent chromium ions. Also, since the plating efficiency of the electrolyte is relatively high, a commercial trivalent chromium electrolyte can have less than 10 mM chromium. This removes the need for expensive rinse water treatment, since the chromium content of the 'drag-out' from the plating electrolyte is extremely low.

In general, the concentration of the constituents in the electrolyte are as follows:

Chromium (III) ions: $10^{-3}$ to 0.01 M

Sulphur species: $10^{-5}$ to $10^{-2}$M

A practical chromium/complexant ligand ratio is approximately 1:1

Above a minimum concentration necessary for acceptable plating rates, it is unnecessary to increase the amount of the sulphur species in proportion to the concentration of chromium in the electrolyte. Excess of sulphite or dithionite may not be harmful to the plating process, but can result in an increased amount of sulphur being co-deposited with the chromium metal. This has two effects, firstly, to produce a progressively darker deposit and, secondly, to produce a more ductile deposit.

The preferred source of trivalent chromium is chromium sulphate which can be in the form of a commercially available mixture of chromium and sodium sulphates known as tanning liquor or chrometan. Other trivalent chromium salts, which are more expensive than the sulphate, can be used, and include chromium chloride, carbonate and perchlorate.

The preferred buffer agent used to maintain the pH of the bulk electrolyte comprises boric acid in high concentrations, i.e., near saturation. Typical pH range for the electrolyte is in the range 2.5 to 4.5.

The conductivity of the electrolyte should be as high as possible to minimize both voltage and power consumption. Voltage is often critical in practical plating environments since rectifiers are often limited to a low voltage, e.g., 8 volts. In an electrolyte in which chromium sulphate is the source of the trivalent chromium ions, a mixture of sodium and potassium sulphate is the optimum. Such a mixture is described in United Kingdom patent specification No. 2,071,151.

A wetting agent is desirable and a suitable wetting agent is FC98, a product of the 3M Corporation. However, other wetting agents, such as sulphosuccinates or alcohol sulphates, may be used.

A perfluorinated cation exchange membrane separates the anode from the plating electrolyte, as described in United Kingdom patent specification No. 1,602,404. A suitable perfluorinated cation exchange membrane is Nafion (trademark), a product of the E. I. du pont de Nemours & Co. It is particularly advantageous to employ an anolyte which has sulphate ions when the catholyte uses chromium sulphate as the source of chromium, since inexpensive lead or lead alloy anodes can be used. In a sulphate anolyte, a thin conducting layer of lead oxide is formed on the anode.

Chloride salts in the catholyte should be avoided since the chloride anions are small enough to pass through the membrane in sufficient amount to cause both the evolution of chlorine at the anode and the formation of a highly resistive film of lead chloride on lead or lead alloy anodes. Cation exchange membranes have the additional advantage in sulphate electrolytes that the pH of the catholyte can be stabilized by adjusting the pH of the anolyte to allow hydrogen ion transport through the membrane to compensate for the increase in pH of the catholyte by hydrogen evolution at the cathode. Using the combination of a membrane, and sulphate based anolyte and catholyte, a plating bath has been operated for over 40 Amphours/liter without pH adjustment.

The invention will now be described with reference to detailed Examples. In each Example, a bath consisting of anolyte separated from a catholyte by a Nafion cation exchange membrane is used. The anolyte comprises an aqueous solution of sulphuric acid in 2% by volume concentration (pH 1.6). The anode is a flat bar of a lead alloy of the type conventionally used in hexavalent chromium plating processes.

The catholyte for each Example was prepared by making up a bse electrolyte and adding appropriate amounts of chromium (III), complexant and sulphite or dithionite.

The base electrolyte consisted of the following constituents dissolved in 1 liter of water:

Potassium sulphate: 1 M
Sodium sulphate: 0.5 M
Borac acid: 1 M
Wetting agent FC98: 0.1 gram

EXAMPLE 1

The following constituents were dissolved in the base electrolyte:

Chromium (III): 5 mM (from chrometan)
DL aspartic acid: 5 mM
Sodium sulphite: 5 mM
at pH: 3.5

Although equilibration will occur quickly in normal use, initially the electrolyte is preferably equilibrated until no spectroscopic changes can be detected. The bath was found to operate over a temperature range of 25° to 60° C. Good bright deposits of chromium were obtained over a current density range of 10 to 800 $mA/cm^2$.

EXAMPLE 2

The following constituents were dissolved in the base electrolyte:

Chromium (III): 5 mM (from chrometan)
Iminodiacetic acid: 5 mM
Sodium dithionite: 2 mM
at pH: 3.5

The electrolyte is preferably equilibrated until there are no spectroscopic changes. The bath was found to operate over a temperature range of 25° to 60° C. Good bright deposits of chromium were obtained.

EXAMPLE 3

The following constituents were dissolved in the base electrolyte:

Chromium (III): 50 mM (from chrometan)
DL Aspartic acid: 50 mM
Sodium sulphite: 10 mM
at pH: 3.5

The electrolyte is preferably equilibrated until there are no spectroscopic changes. The bath was found to operate over a temperature range of 25° to 60° C. Good bright deposits were obtained.

EXAMPLE 4

The following constituents were dissolved in the base electrolyte:

Chromium (III): 50 mM (from chrometan)
5-sulphosalicylic acid: 50 mM
Sodium sulphite: 1 mM
at pH: 3.5

The electrolyte is preferably equilibrated until there are no spectroscopic changes. The bath was found to operate over a temperature range of 25° to 60° C. Good bright deposits were obtained.

While the invention has been particularly shown and described with reference to preferred embodiments thereof, it will be understood by those skilled in the art that various changes in form and details may be made therein without departing from the spirit and scope of the invention.

What is claimed is:

1. A chromium electroplating electrolyte containing trivalent chromium ions, a complexant, a buffer agent and a sulphur species selected from sulphites and dithionites, the complexant being selected from aspartic acid, 5-sulphosalicylic acid and citric acid.

2. An electrolyte as claimed in claim 1 in which the sulphite is selected from sulphites, bisulphites and metabisulphites.

3. An electrolyte as claimed in claim 2 in which the buffer agent is boric acid.

4. An electrolyte as claimed in claim 3 in which the source of chromium ions is chromium sulphate, and including conductivity ions selected from sulphate salts.

5. An electrolyte as claimed in claim 4 in which the conductivity ions are provided by a mixture of about 0.5 M sodium and about 1 M potassium sulphate.

6. A chromium electroplating bath comprising an anolyte separated from a catholyte by a perfluorinated cation exchange membrane; the anolyte comprising sulphate ions; and the catholyte comprising a source of trivalent chromium ions, a complexant selected from aspartic acid, iminodiacetic acid, nitrilotriacetic acid, 5-sulphosalicylic acid or citric acid, a buffer agent, and a sulphur species selected from sulphites and dithionites, and in which the source of sulphate ions is chromium sulphate.

7. A bath as claimed in claim 6 in which the sulphite is selected from sulphites, bisulphites and metabisulphites.

8. A bath as claimed in claim 7 in which the buffer agent is boric acid.

9. A bath as claimed in claim 6 in which the source of chromium sulphate is chrometan, in which the sulphite is selected from sulphites, bisulphites and metabisulphites, in which the buffer agent is boric acid, and including conductivity ions selected from sulphate salts.

10. A bath as claimed in claim 9 in which the sulphate salt conductivity ions are provided by a mixture of about 0.5 M sodium and about 1 M potassium sulphate.

11. A bath as claimed in claim 6 in which the source of chromium sulphate is chrometan, in which the sulphite is selected from sulphites, bisulphites and metabisulphites, in which the buffer agent is boric acid, sulphate salt conductivity ions provided by a mixture of about 0.5 M sodium and about 1 M potassium sulphate, including a lead or lead alloy anode immersed in said anolyte.

* * * * *